US008599095B2

(12) United States Patent
Wu

(10) Patent No.: US 8,599,095 B2
(45) Date of Patent: Dec. 3, 2013

(54) BROADBAND BALLISTIC RESISTANT RADOME

(75) Inventor: Kuang-Yuh Wu, Plano, TX (US)

(73) Assignee: Raytheon Company, Waltham, MA (US)

( * ) Notice: Subject to any disclaimer, the term of this patent is extended or adjusted under 35 U.S.C. 154(b) by 1297 days.

(21) Appl. No.: 12/016,867

(22) Filed: Jan. 18, 2008

(65) Prior Publication Data

US 2012/0092229 A1 Apr. 19, 2012

Related U.S. Application Data

(63) Continuation-in-part of application No. 11/297,999, filed on Dec. 8, 2005, now Pat. No. 7,817,099.

(51) Int. Cl.
*H01Q 1/42* (2006.01)

(52) U.S. Cl.
USPC ..... 343/872

(58) Field of Classification Search
USPC ..... 343/872
See application file for complete search history.

(56) References Cited

U.S. PATENT DOCUMENTS

| | | | | |
|---|---|---|---|---|
| 2,854,374 A | | 12/1973 | McMillan et al. | |
| 3,780,374 A | | 12/1973 | Shibano et al. | 343/872 |
| 4,358,772 A | * | 11/1982 | Leggett | 343/872 |
| 4,613,540 A | | 9/1986 | Traut et al. | 428/212 |
| 4,783,666 A | | 11/1988 | Ast et al. | |
| 4,868,040 A | | 9/1989 | Hallal et al. | 428/251 |
| 5,182,155 A | | 1/1993 | Roe | 428/116 |
| 5,408,244 A | * | 4/1995 | Mackenzie | 343/872 |
| 6,107,976 A | | 8/2000 | Purinton | |
| 6,767,606 B2 | | 7/2004 | Jackson et al. | |
| 7,688,278 B2 | | 3/2010 | Frenkel | |
| 7,817,099 B2 | | 10/2010 | Wu et al. | |
| 2002/0113168 A1 | | 8/2002 | Rukavina et al. | |
| 2004/0227687 A1 | * | 11/2004 | Delgado et al. | 343/872 |
| 2004/0246195 A1 | * | 12/2004 | Usami et al. | 343/872 |
| 2009/0286040 A1 | | 11/2009 | Gerken et al. | |

FOREIGN PATENT DOCUMENTS

| | | | |
|---|---|---|---|
| DE | 11 07 299 B | 5/1961 | |
| DE | 102 57 370 B3 | 6/2004 | |
| EP | 1 710 218 A1 | 10/2006 | C04B 35/584 |
| EP | 1 796 210 A1 | 6/2007 | H01Q 1/42 |
| GB | 2 336 807 A | 4/1998 | F41H 5/04 |
| WO | WO 2006/011133 A1 | 2/2006 | |

OTHER PUBLICATIONS

Wu, et al.; U.S. Appl. No. 12/258,209; entitled "Honeycomb-Backed Armored Radome" (20 pages), Oct. 24, 2008.
USPTO Office Action for U.S. Appl. No. 12/258,209, 27 pages, Dec. 9, 2010.
Communication Pursuant to Article 94(3) EPC; for application 09 150 813.5-2220 (4 pages) Sep. 8, 2011.

(Continued)

*Primary Examiner* — Robert Karacsony
(74) *Attorney, Agent, or Firm* — Cantor Colburn LLP

(57) ABSTRACT

According to one embodiment of the invention, a radome cover for an RF sensor has been provided. The radome cover comprises a first and a second ballistic layer, each ballistic layer having a ceramic layer. The two ballistic layers are sandwiched between at least two matching layers, and the matching layers are impedance matched to the ceramic layers. The radome cover provides ballistic protection for the RF sensor.

24 Claims, 10 Drawing Sheets

(56) References Cited

OTHER PUBLICATIONS

European Search Report for Application No. 09150813.5-2220/2081252, 8 pages, Dec. 22, 2009.

European Search Report for Application No. 06256063.6-2220, 9 pages, Mar. 9, 2007.

* cited by examiner

BROADBAND BALLISTIC RESISTANT RADOME

RELATED APPLICATION

This application is a Continuation-In-Part of U.S. patent application Ser. No. 11/297,999 filed Dec. 8, 2005, entitled Broadband Ballistic Resistant Radome.

TECHNICAL FIELD OF THE INVENTION

This invention relates generally to the housing of RF sensors and, more particularly, to a broadband ballistic resistant radome.

BACKGROUND OF THE INVENTION

Among RF sensors, Electronic scanned array (ESA) sensors are expensive, hard to replace in a battle field, and essential in a variety of applications. For example, ESA sensors may be used to detect the location of objects or individuals. In detecting the location of such objects or individuals, ESA sensors may utilize a plurality of elements that radiate signals with different phases to produce a beam via constructive or destructive interference. The direction the beam points is dependent upon the differences of the phases of the elements and how the radiation of the elements constructively or destructively force the beam to point in a certain direction. Accordingly, the beam can be steered to a desired direction by simply changing the phases of the elements. Using such steering, the ESA sensors may both transmit and receive signals, thereby detecting the presence of the object or individual.

When ESA sensors are used in combat settings, difficulties can arise. For example, ESA sensors may be exposed to gunfire and fragmentation armaments, which can disable portions of the ESA sensors or render the ESA sensors inoperable.

SUMMARY OF THE INVENTION

Given the above difficulties that can arise, it is desirable to produce a radome cover for an RF sensor housing with acceptable ballistic protection, acceptable power transmission for a desired frequency band, and acceptable scan volume.

According to one embodiment of the invention, a radome cover for an RF sensor has been provided. The radome cover comprises a first and a second ballistic layer, each ballistic layer having a ceramic layer. The two ballistic layers are sandwiched between at least two matching layers, and the matching layers are impedance matched to the ceramic layers. The radome cover provides ballistic protection for the RF sensor.

Certain embodiments of the invention may provide numerous technical advantages. For example, a technical advantage of one embodiment may include the capability to provide a radome cover that is substantially transparent to electromagnetic signals while maintaining a capability to dissipate kinetic energy of moving objects, namely ballistics such as bullets and fragmentation armaments. Particular embodiments of the invention may provide protection from multiple hits by ballistic objects.

Other technical advantages of other embodiments may include the capability to provide a radome cover that has a low permeation path for water vapor to protect non-hermetic electronics.

Although specific advantages have been enumerated above, various embodiments may include all, some, or none of the enumerated advantages. Additionally, other technical advantages may become readily apparent to one of ordinary skill in the art after review of the following figures and description.

BRIEF DESCRIPTION OF THE DRAWINGS

For a more complete understanding of example embodiments of the present invention and its advantages, reference is now made to the following description, taken in conjunction with the accompanying drawings, in which.

DETAILED DESCRIPTION OF EXAMPLE EMBODIMENTS OF THE INVENTION

It should be understood at the outset that although example embodiments of the present invention are illustrated below, the present invention may be implemented using any number of techniques, whether currently known or in existence. The present invention should in no way be limited to the example embodiments, drawings, and techniques illustrated below, including the embodiments and implementation illustrated and described herein. Additionally, while some embodiments will be described with reference to an electronic scanned array (ESA) RF components, other RF components, including, but not limited to antennas, sensors (including single RF sensors), radiating devices, and others may avail themselves of the teachings of the embodiments of the invention. Further, such ESA and other RF components may operate at any of a variety of frequencies. Furthermore, the drawings are not necessarily drawn to scale.

In combat settings, it may be desirable to utilize electronic scanned array (ESA) sensors to detect a presence of objects or individuals. However, difficulties can arise. The ESA sensors may be exposed to gunfire and fragmentation armaments, which can disable portions of the ESA sensors or render the ESA sensors inoperable. Accordingly, teachings of some embodiments of the invention recognize a radome cover that minimizes transmission loss for electromagnetic signals while providing suitable ballistic protection for electronics transmitting or receiving the electromagnetic signals. Additionally, teachings of other embodiments of the invention recognize a radome cover that provides a low permeation path for water vapor, thereby protecting non-hermetic electronics.

Figure 1:
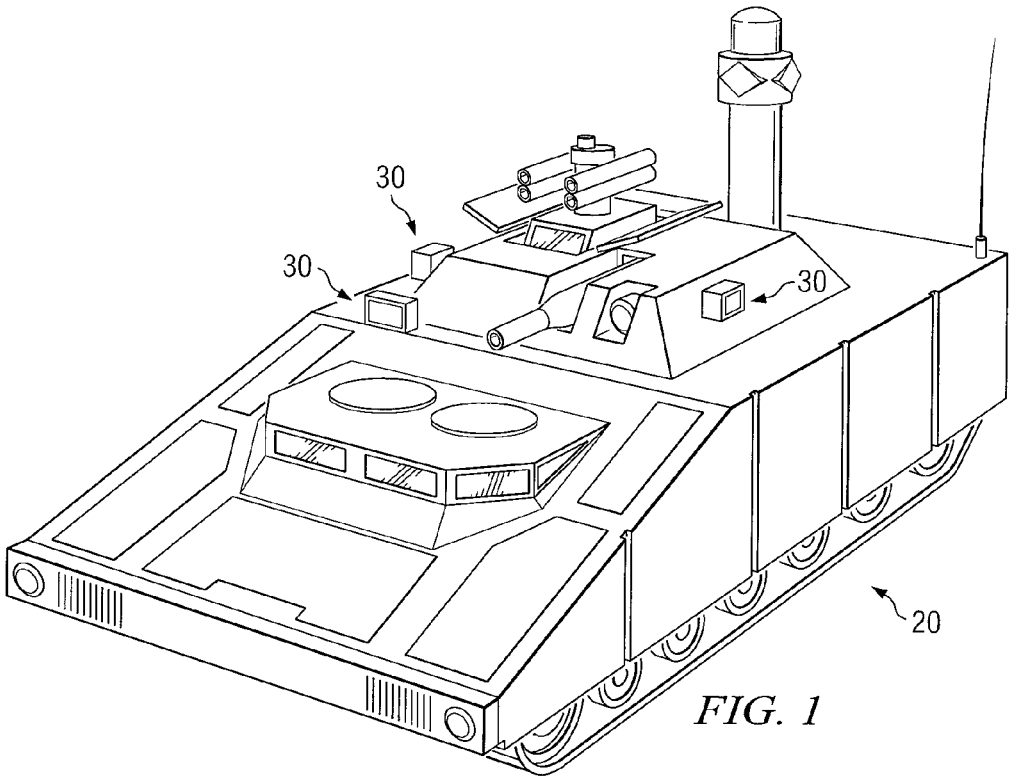
FIG. 1 shows an illustrative environmental view of a plurality of active electronically scanned arrays (AESA) units disposed around an armored vehicle, according to an embodiment of the invention.
Figure 2:
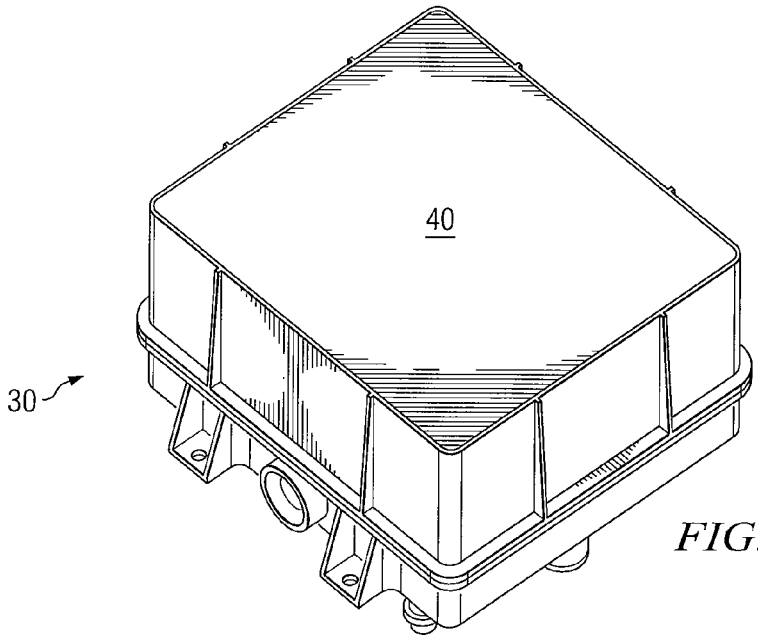
FIG. 2 shows an exploded view of one of the AESA units of FIG. 1.

FIG. 1 shows an illustrative environmental view of a plurality of active electronically scanned arrays (AESA) units 30 disposed around an armored vehicle 20, according to an embodiment of the invention. FIG. 2 shows an exploded view of one of the AESA units 30 of FIG. 1. Upon the armored vehicle 20, the AESA units 30 may be exposed to ballistics (i.e., gunfire or the like) or fragmentation armaments. Accordingly, the AESA units may be constructed of a variety of materials to protect the electronics within the AESA units 30. To allow electromagnetic radiation to propagate though a portion of the AESA unit 30, one side of the AESA unit 30 includes a radome cover 40 disposed over an aperture or window 32 (seen in FIG. 3). Further details of the radome cover 40 are described in greater detail below. The remainder of AESA unit 30 may be protected with any suitable material (e.g., metal, ceramics, or the like) to resist ballistics (i.e., gunfire or the like) or fragmentation armaments. In particular embodiments, the AESA unit 30 may be transmitting or receiving in the Ka frequency band. In other embodiments, the AESA unit 30 may be transmitting or receiving in other frequency bands. Accordingly, it should be expressly understood that embodiments may utilize any suitable RF frequency band.

Figure 3:
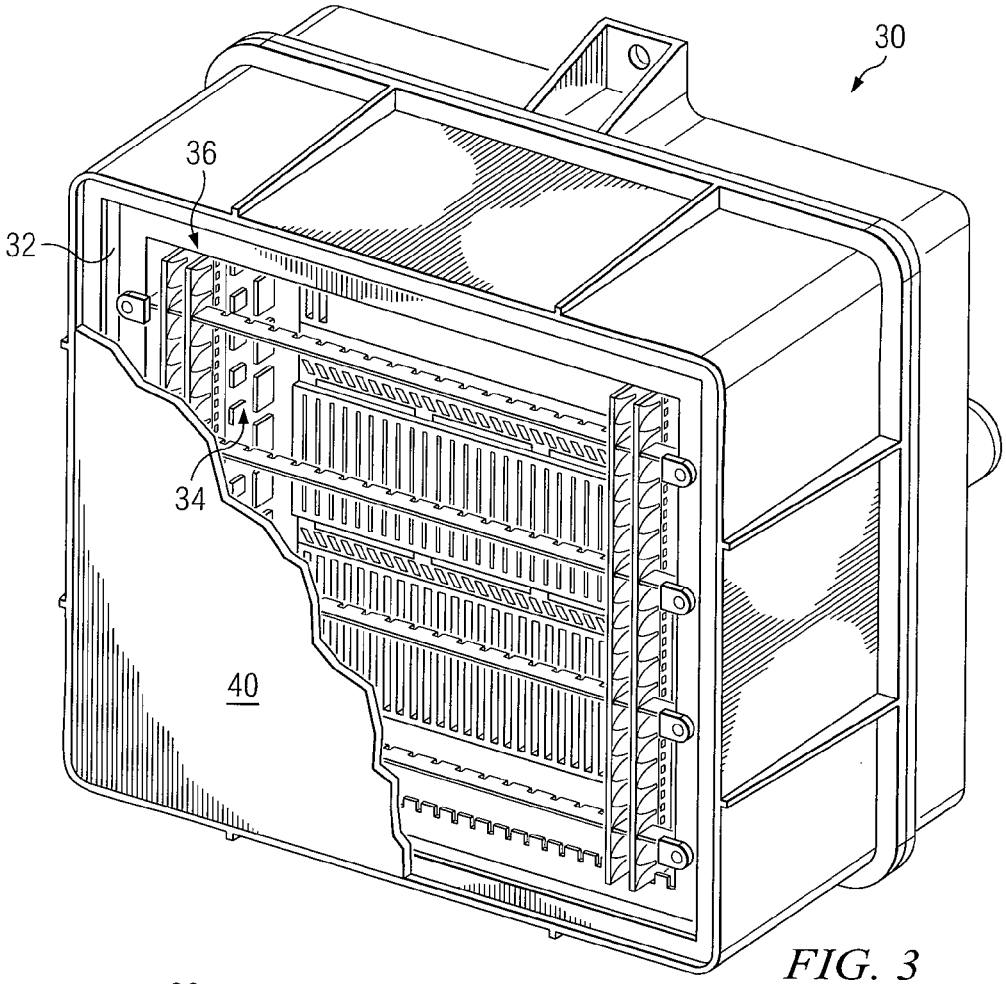
FIGS. 3 and 4 illustrates further details of an AESA unit, according to an embodiment of the invention.
Figure 4:
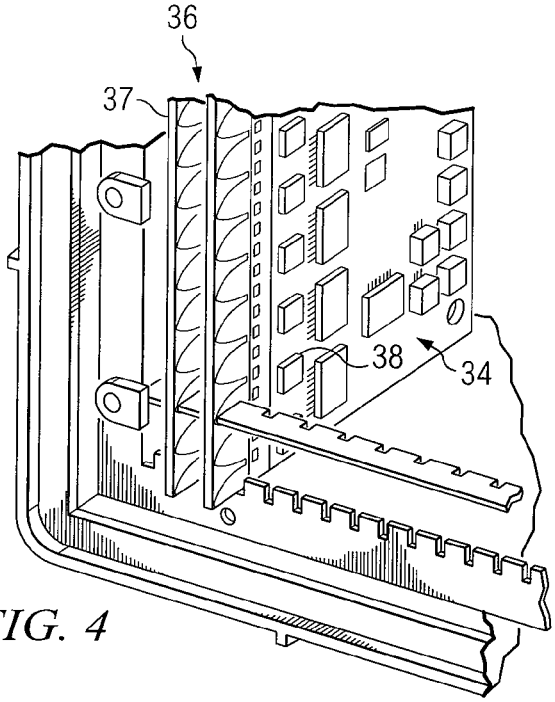

FIGS. 3 and 4 illustrates further details of an AESA unit 30, according to an embodiment of the invention. The AESA unit 30 of FIG. 3 has a portion of the radome cover 40 removed to reveal a portion of the electronic components 34 and an antenna array 36 within the AESA unit 30. The radome cover 40 covers a window 32 through which the antenna array 36 and electronic components 34 may electronically scan for individuals or objects.

The radome cover 40 may be designed with a two-fold purpose of being transparent to electromagnetic signals while maintaining a capability to dissipate kinetic energy of moving objects, namely bullets and fragmentation armaments. Further details of embodiments of the radome cover 40 will be described below.

FIG. 4 is an exploded view of the electronic components 34 and the antenna array 36 of FIG. 3. For purposes of illustration, the entirety of the antenna array 36 has not been shown. As will be recognized by one of ordinary skill in the art, antenna arrays 36 may utilize a plurality of elements that radiate signals with different phases to produce a beam via constructive/destructive interference. The direction the beam points is dependent upon differences of the phases of the elements and how the radiation of the elements constructively or destructively force the beam to point in a certain direction. Therefore, the beam can be steered to a desired direction by simply changing the phases of the elements. Using such steering, in particular embodiments the antenna array 36 may both transmit and receive signals.

In this embodiments, the radiating elements are shown as flared notched radiators 37. Although flared notch radiators 37 are shown in the embodiment of FIG. 4, other embodiments may utilize other typed of radiating elements, including but not limited to monopole radiators, other radiators, or combinations of the preceding.

The electronic components 34 in this embodiment include a Transmit Receive Integrated Microwave Module (TRIMM) assembly with a power amplifier monolithic microwave integrated circuits (P/A MMIC) 38. A variety of other components for electronic components 34 may additionally be utilized to facilitate an operation of the AESA unit 30, including but not limited, phase shifters for the flared notched radiators 36.

The components of the antenna array 36 and the electronic components 34 are only intended as showing one example of an RF technology. A variety of other RF technology configurations may avail themselves of the teachings of embodiments of the invention. Accordingly, the electronic components 34 or antenna array 36 may include more, less, or different components that those shown in FIGS. 3 and 4. Such components may include, but are not limited to, antennas, sensors (including single RF sensors), radiating devices, and others.

Figure 5A:
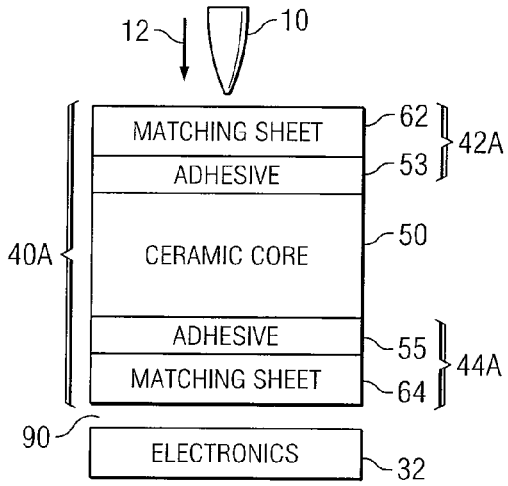
FIG. 5A shows a cross sectional view of a radome cover, according to an embodiment of the invention.

FIG. 5A shows a cross sectional view of a radome cover 40A, according to an embodiment of the invention. Disposed underneath the radome cover 40A beneath a deflection zone or air gap 90 is RF components or electronics 32, which may comprise any of a variety of RF components, including, but not limited to, electronic components 34 and antenna array 36 discussed above with reference to FIGS. 3 and 4. As referenced above, the RF components or electronics 32 may include more, fewer, or different components than those described herein. Any suitable configuration of RF sensor components may avail themselves of the embodiments described herein.

The radome cover 40A may protect the RF components or electronics 32 from being disturbed by a moving object. For example, the radome cover 40A may protect the electronics from a ballistic object 10 moving in the direction of arrow 12 by converting the kinetic energy of the ballistic object 10 into thermal energy. During protection of such electronics 32, electromagnetic radiated signals are allowed to propagate in both directions through the layers of the radome cover 40A to and from the electronics 32.

The radome cover 40A in the embodiment of FIG. 5A includes a core 50 sandwiched between matching layers 42A, 44A. "Layer" as utilized herein may refer to one or more materials. Accordingly, in particular embodiments, matching layer 42A and matching layer 44A may only have one material. In other embodiments, matching layer 42A and/or matching layer 44A may have more than one material. Further detail of matching layers 42A and 44A are described below.

In particular embodiments, the type of material and thickness of the core 50 may be selected according to a desired level of protection. The core 50 may be made of one or more than one type of material. In particular embodiments, the core 50 may be made of a ceramic composite containing alumina (also referred to as aluminum oxide). Ceramic composites, containing alumina, may comprise a variety of percentage of alumina including, but not limited to, 80% alumina up to 99.9% alumina. In particular embodiments, the core 50 may utilize a ballistic grade of ceramic containing higher percentages of alumina. Although the core 50 is made of alumina in the embodiment of FIG. 5A, in other embodiments the core may be made of other materials. In particular embodiments, a thicker alumina core 50 will provide more protection. The core 50 may be monolithic or tiled in construction. In the case of tiles, hexagonal tiles, for example, can be bonded in place to form a layer which better addresses multi-hit capability. Further details of tiling configurations are provided below with reference to FIG. 9.

Suitable thicknesses for the core 50 in this embodiment include thicknesses between 0.5 inches and 3.0 inches. In other embodiments, the thickness of the core 50 may be less than or equal to 0.5 inches and greater than or equal to 3.0 inches. In particular embodiments, the core 50 may additionally provide for a ultra-low permeation path of water vapor, thereby protecting non-hermetic components that may exist in the electronics 32.

The matching layers 42A, 44A are utilized to impedance match the radome cover 40A for optimum radio frequency (RF) propagation through the radome cover 40A. Such impedance matching optimizes the radome cover 40A to allow higher percentage of electromagnetic power to be transmitted through the radome cover 40A, thereby minimizing RF loss. The concept of impedance matching should become apparent to one of ordinary skill in the art. Impedance matching in the embodiment of FIG. 5A may be accomplished through selection of particular types and thickness of matching layers 42A, 44A. Selection of the type of and thickness of the matching layers 42A, 44A in particular embodiments may vary according to the properties of the core 50 and operating frequencies of the RF components or electronics 32. That is, the selection of the type and thickness of the matching layers 42A, 44A may be dependent on the selection of the type and thickness of the core 50. Any of variety of radome design tools may be used for such a selection.

In the embodiment of FIG. 5A, matching layer 42A includes adhesive 53 and RF matching sheet 62, and matching layer 44A includes adhesive 55 and RF matching sheet 64. Suitable materials for the RF matching sheets 62, 64 include, but are not limited to, synthetic fibers such as polyethylenes marketed as SPECTRA® fiber and under the SPECTRA SHIELD® family of products. The adhesives 53, 55 couples the RF matching sheets 62, 64 to the ceramic core 50. Any of a variety of adhesives may be utilized.

In particular embodiments, the core 50 may have a high dielectric constant, for example, greater than six ("6") whereas the RF matching sheets 62, 64 may have a low dielectric constant, for example, less than three ("3"). In embodiments in which the core 50 is alumina, the core may have a dielectric constant greater than nine ("9").

Figure 6A:
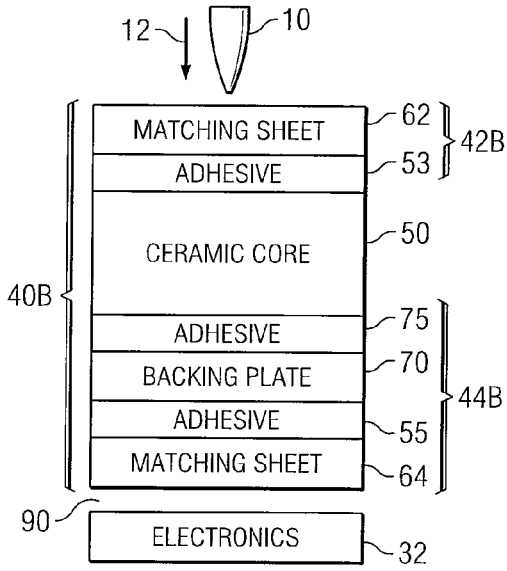
FIG. 6A shows a cross sectional view of a radome cover, according to another embodiment of the invention.

FIG. 6A shows a cross sectional view of a radome cover 40B, according to another embodiment of the invention. The radome cover 40B of FIG. 6A is similar to the radome cover 40A of FIG. 5A, including a core 50 sandwiched between matching layers 42B, 44B, except that the radome cover 40B of FIG. 6A additionally includes a backing plate 70 in matching layer 44B. Similar to that described above with reference to FIG. 5A, the matching layers 42B, 44B are utilized to impedance match the radome cover 40B for optimum radio frequency (RF) propagation through the radome cover 40B. Accordingly, the selection of the type of and thickness of the matching layers 42B, 44B in particular embodiments may vary according to the properties of the core 50 and operating frequencies of the RF components or electronics 32.

In particular embodiments, the backing plate 70 may provide structural stability (in the form of stiffness) to prevent the core 50 from going into tension, for example, when a size of the window 32 (shown in FIG. 3) increases. The backing plate 70 in particular embodiments may also serve as a "last catch" to prevent fragments from entering the RF components or electronics 32. Further, the backing plate 70 may act as a spall liner. Suitable materials for the backing plate 70 include, but are not limited to, ceramic materials marketed as NEXTEL™ material by 3M Corporation. An adhesive 75, similar or different than adhesives 53,55, may be utilized between the backing plate and the ceramic core 50. In particular embodiments, the backing plate 70 may have a dielectric constant between three ("3") and seven ("7").

Figure 7A:
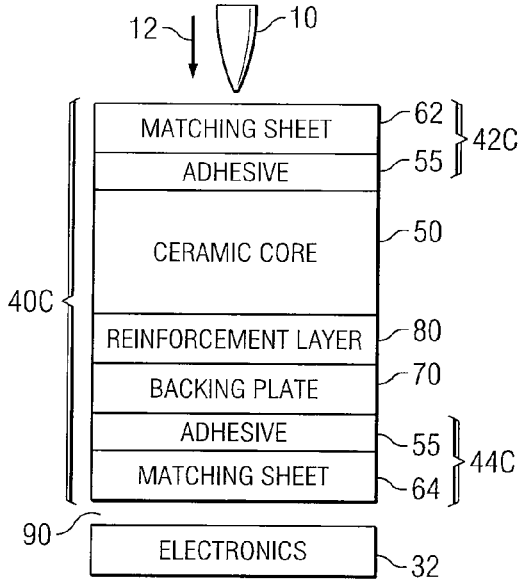
FIG. 7A shows a cross sectional view of a radome cover, according to another embodiment of the invention.

FIG. 7A shows a cross sectional view of a radome cover 40C, according to another embodiment of the invention. The radome cover 40C of FIG. 7A is similar to the radome cover 40B of FIG. 6A including a core 50 sandwiched between matching layers 42C, 44C, except that the radome cover 40C of FIG. 7A includes a reinforcement layer 80 in the matching layer 44C. Similar to that described above with reference to FIG. 5A, the matching layers 42C, 44C are utilized to impedance match the radome cover 40C for optimum radio frequency (RF) propagation through the radome cover 40B. Accordingly, the selection of the type of and thickness of the matching layers 42C, 44C in particular embodiments may vary according to the properties of the core 50 and operating frequencies of the RF components or electronics 32.

In particular embodiments, the reinforcement layer 80 may be made of rubber or other suitable material that provides additional dissipation or absorption of the kinetic energy. In particular embodiments, matching layer 42C may also include a reinforcement layer 80. In particular embodiments, the reinforcement layer 80 may have a dielectric constant between three ("3") and seven ("7").

Figure 10A:
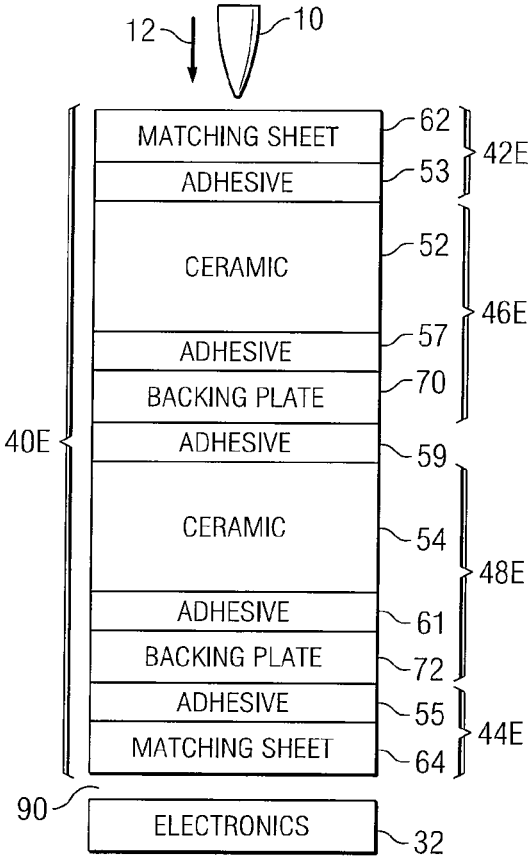
FIG. 10A shows a cross sectional view of a radome cover of equal ceramic core thickness, according to an embodiment of the invention.

FIG. 10A shows a cross sectional view of a radome cover 40E, according to another embodiment of the invention. The radome cover 40E of FIG. 10A is similar to the radome cover 40B of FIG. 6A. Sandwiched between matching layers 42E and 44E are ballistic layers 46E and 48E. Ballistic layers 46E and 48E each include a ceramic layer 52 and 54 and a backing plate 70 and 72. The backing plate 70, 72 is secured to the ceramic layer 52, 54 with adhesive 57, 61.

The adhesives may be similar or different than adhesives 53, 55. In particular embodiments, bonding material that is transparent to radio frequencies may be used in adhesives 57, 61, 53, 55, 59. Adhesive 59 may be used to bond the ballistic layers 46E and 48E together.

In particular embodiments of the invention, ceramic layer 52 may be approximately the same thickness as ceramic layer 54. Ceramic layers 52 may also have a different thickness from ceramic layer 54 as illustrated by FIG. 11A which illustrates an embodiment where ceramic layer 52 is three times the thickness of ceramic layer 54.

In particular embodiments, the ceramic layers may contain a ceramic composite containing alumina. Additionally, some, all, or none of the ceramic layers may include silicon nitride. In particular embodiments, the ceramic layer 52B may include alumina and the ceramic layer 54B may include silicon nitride. In particular embodiments, advantages of using silicon nitride or other materials may be a reduced weight of the radome cover over a cover with ceramic layers composed of a ceramic composite containing alumina.

Multiple ballistic layers sandwiched between matching layers may be particularly suitable to protect electronics 32 from a multi-ballistic-hit environment. Physical properties of ceramics will cause a ceramic layer to crack through the layer when the ceramic layer is struck on the surface. By securing backing plate 70 between ceramic layers 52 and 54, the propagation of cracks due to an impact may be stopped by backing plate 70. Thus, a second hit of radome cover 40E may be withstood by ceramic layer 54 which likely remained intact after the first hit. Thus, a stronger structure for withstanding multi-hits may be provided by radome cover 40E that includes multiple ballistic layers 46E, 48E.

Figure 11A:
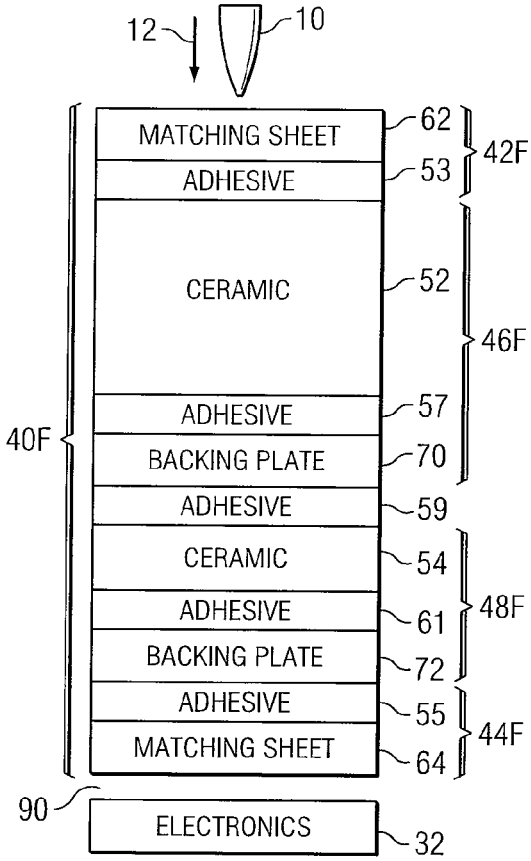
FIG. 11A shows a cross sectional view of a radome cover of unequal ceramic core thickness, according to an embodiment of the invention.

Although FIGS. 10A and 11A illustrate two ballistic layers, other embodiments may include three or more ballistic layers sandwiched between matching layers 42E and 44E. In addition, a reinforcement layer similar to reinforcement layer 80 shown in FIG. 7A may be used as a shock absorber to catch additional force from a ballistic impact, or multiple ballistic impacts, with radome cover 40E. A reinforcement layer may be included in some, all, or none of ballistic layers 46E and 48E.

Ceramic layers 52 and 54 may vary in thickness. In certain embodiments, each ceramic layer may be approximately 0.5 inches thick. In other embodiments, either of ceramic layers 52 or 54 may have a thickness of more or less than 0.5 inches. In the embodiment shown in FIG. 11A, ceramic layer 52 of ballistic layer 46F may be 0.75 inches thick and ceramic layer 54 of ballistic layer 48F may be 0.25 inches thick.

Matching layers 42E, 44E impedance match the radome cover 40E for optimum radio frequency propagation through radome cover 40E. Impedance matching in the embodiment of FIG. 10A may be accomplished through selection of particular types and thicknesses of matching layers 42E, 44E. In the embodiment of FIG. 10A, matching layer 42E includes adhesive 53 and RF matching sheet 62. Matching layer 44E includes adhesive 55 and RF matching sheet 64. The RF matching sheets 62, 64 may include materials similar to matching sheets shown in FIG. 5A and described above.

In particular embodiments, the ceramic layers 52, 54 each may have high dielectric constants, for example, greater than seven ("7") whereas the RF matching sheets 62, 64 may have relatively low dielectric constants. For example, each matching sheet 62, 64 may have a dielectric constant that is less than four ("4"). In particular embodiments the matching sheet 62, 64 may have a dielectric constant of 2.3, and the adhesive 53, 55 may have a dielectric constant of 3.16. In other embodiments, the dielectric constant of the matching sheet 62, 64 may be more or less than 2.3, and the dielectric constant of the adhesive 53, 55 may be more or less than 3.16.

A dielectric constant for each ceramic layer 52, 54 may be greater than or equal to six ("6") and less than or equal to ten ("10"). In particular embodiments, the dielectric constant of each ceramic layer 52, 54 may be greater than or equal to 9.8 and less than or equal to 10. A dielectric constant of each ceramic layer in this range may allow a dielectric constant of each matching layer to be close to four. In particular embodiments, the dielectric constant of matching sheets 62, 64 may be less than 3.5, and preferably 3.1. The dielectric constant of each backing plate 70, 72 may be greater than or equal to three ("3") and less than or equal to seven ("7"). In particular embodiments, the dielectric constant of each backing plate may be approximately 6.14.

Although multi-ballistic layer embodiments have been shown in FIG. 10A as equal sized ceramic layers 52 and 54, and ceramic layer 52 of FIG. 11A is three times the thickness of ceramic layer 54, it should be understood that any proportion of ceramic layer thicknesses may be used by an embodiment of the invention. Accordingly, a ceramic core that is twice as thick as a second ceramic core is within the scope of this disclosure.

Figure 5B:
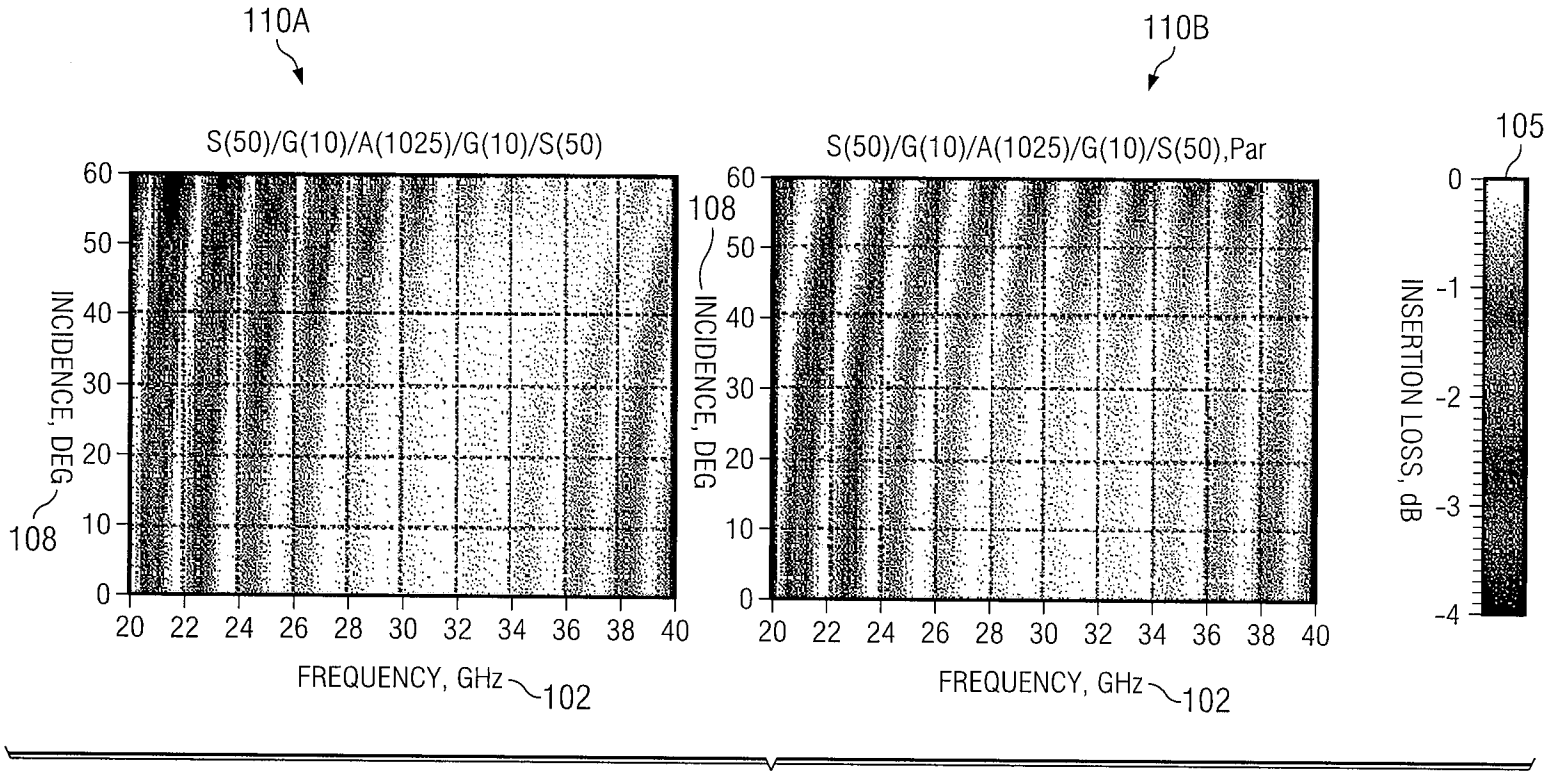
FIG. 5B shows graphs of predicted radome insertion loss corresponding to the radome cover of FIG. 5A.

FIGS. 5B, 6B, 7B, 10B, and 11B are graphs 110A, 110B, 120A, 120B, 130A, 130B, 140A, 140B, 150A, and 150B of predicted radome insertion losses respectively corresponding to radome covers 40A, 40B, 40C, 40E, and 40F of FIGS. 5A, 6A, 7A, 10A, and 11A. These graphs 110A, 110B, 120A, 120B, 130A, 130B, 140A, 140B, 150A, and 150B are intended as illustrating transmission loss performance (via modeling or experimentation) that can be taken for radome covers 40A, 40B, 40C, 40E, and 40F. Although specific RF transmission loss performance for specific radome covers 40A, 40B, 40C, 40E, and 40F are shown in FIGS. 5B, 6B, 7B, 10B, and 11B, other RF performance can be taken for other radome covers 40, according to other embodiments. The graphs 110A, 110B of FIG. 5B are RF transmission loss performance corresponding to the following thicknesses for the radome cover 40A:

| Layer | Thickness (mils) |
|---|---|
| RF Matching Sheet (e.g., SPECTRA ®) | 50 |
| Adhesive | 10 |
| Ceramic Core (e.g., Alumina) | 1025 |
| Adhesive | 10 |
| RF Matching Sheet (e.g., SPECTRA ®) | 50 |

Figure 6B:
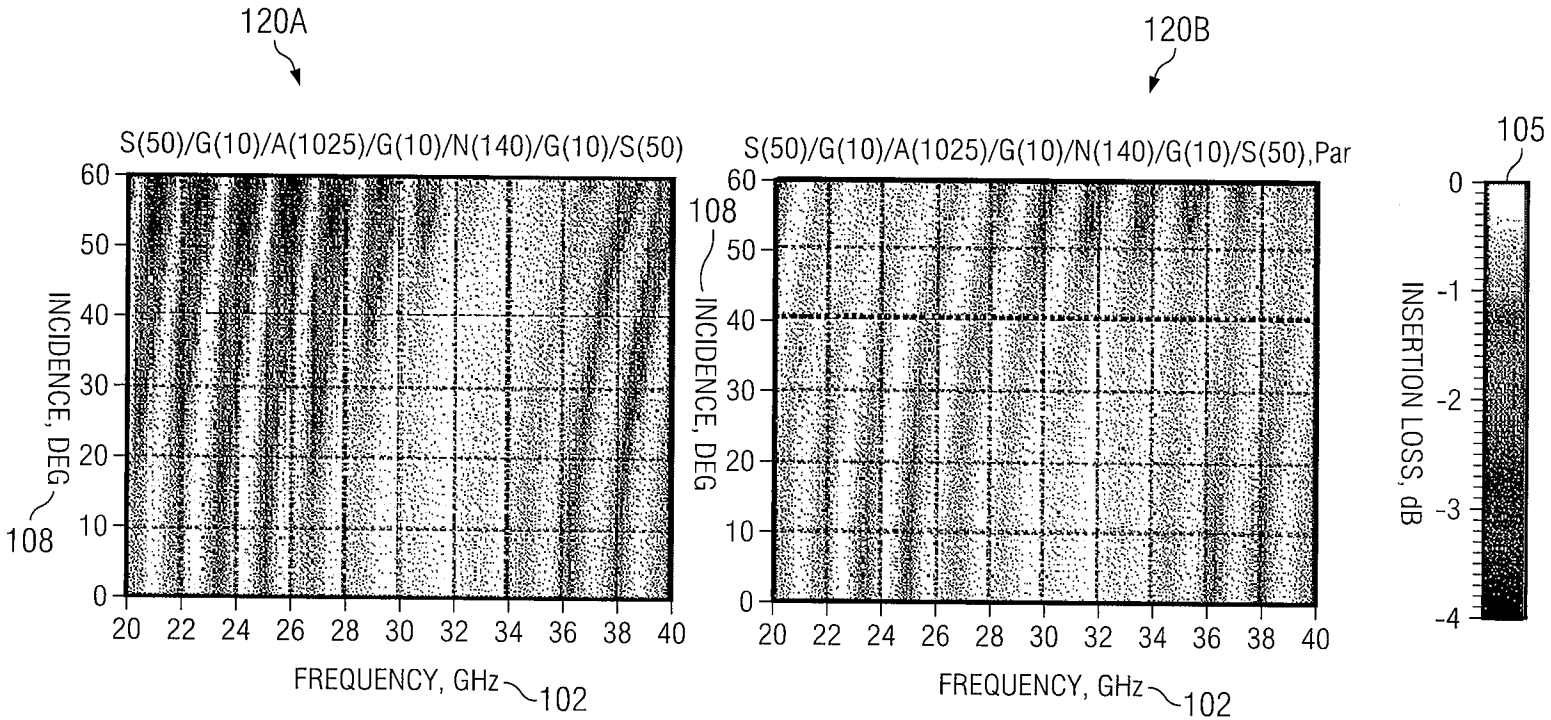
FIG. 6B shows graphs of predicted radome insertion loss corresponding to the radome cover of FIG. 6A.

The graphs 120A, 120B of FIG. 6B are measurements corresponding to the following thicknesses for the radome cover 40B:

| Layer | Thickness (mils) |
|---|---|
| RF Matching Sheet (e.g., SPECTRA ®) | 50 |
| Adhesive | 10 |
| Ceramic Core (e.g., Alumina) | 1025 |
| Adhesive | 10 |
| Backing Plate (e.g., NEXTEL ™) | 140 |
| Adhesive | 10 |
| RF Matching Sheet (e.g., SPECTRA ®) | 50 |

Figure 7B:
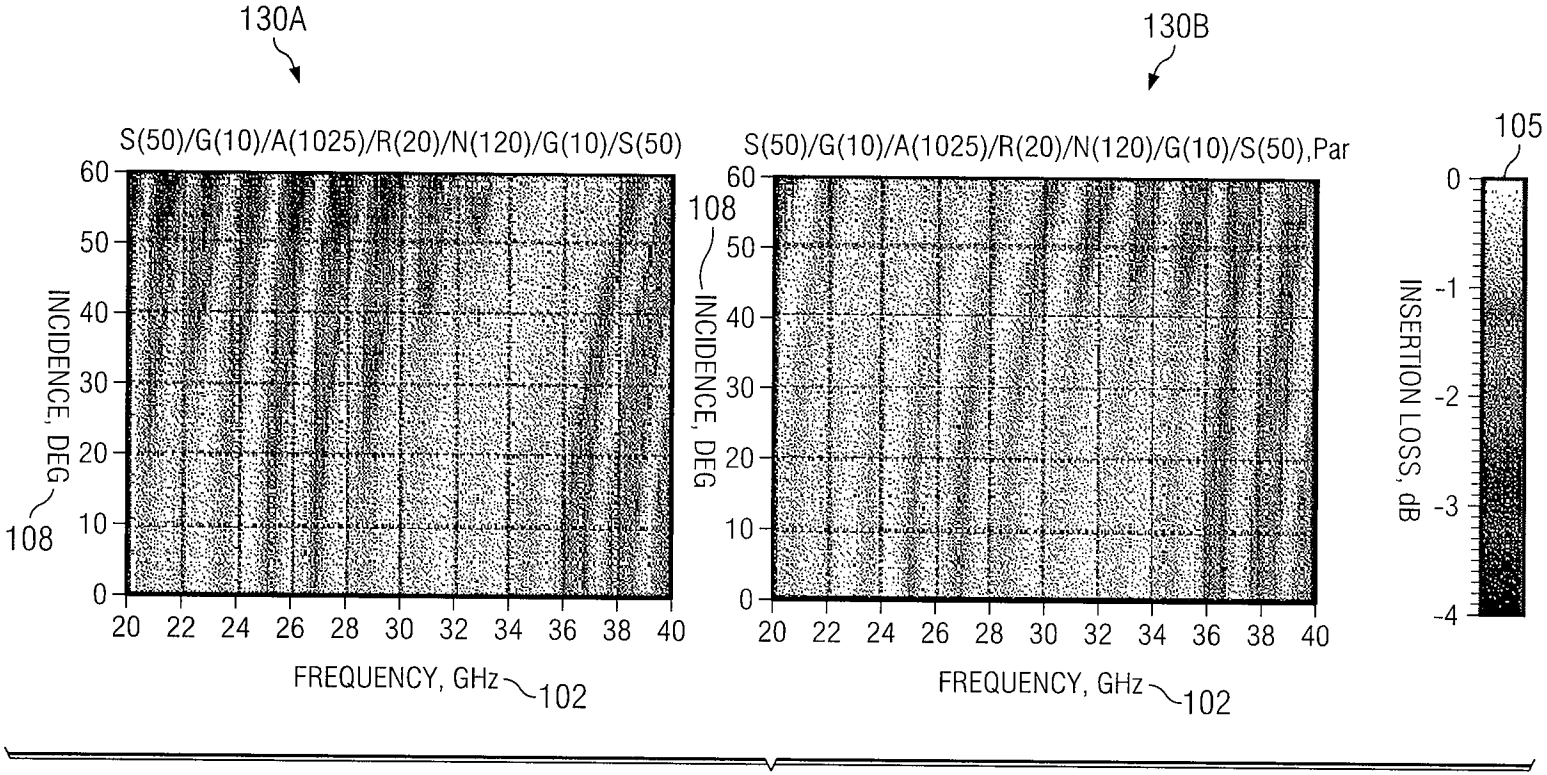
FIG. 7B shows graphs of predicted radome insertion loss corresponding to the radome cover of FIG. 7A.

The graphs 130A, 130B of FIG. 7B are RF transmission loss performance corresponding to the following thicknesses for the radome cover 40C:

| Layer | Thickness (mils) |
|---|---|
| RF Matching Sheet (e.g., SPECTRA ®) | 50 |
| Adhesive | 10 |
| Ceramic Core (e.g., Alumina) | 1025 |
| Reinforcement Layer(e.g., rubber) | 20 |
| Backing Plate (e.g., NEXTEL ™) | 120 |
| Adhesive | 10 |
| RF Matching Sheet (e.g., SPECTRA ®) | 50 |

Figure 10B:
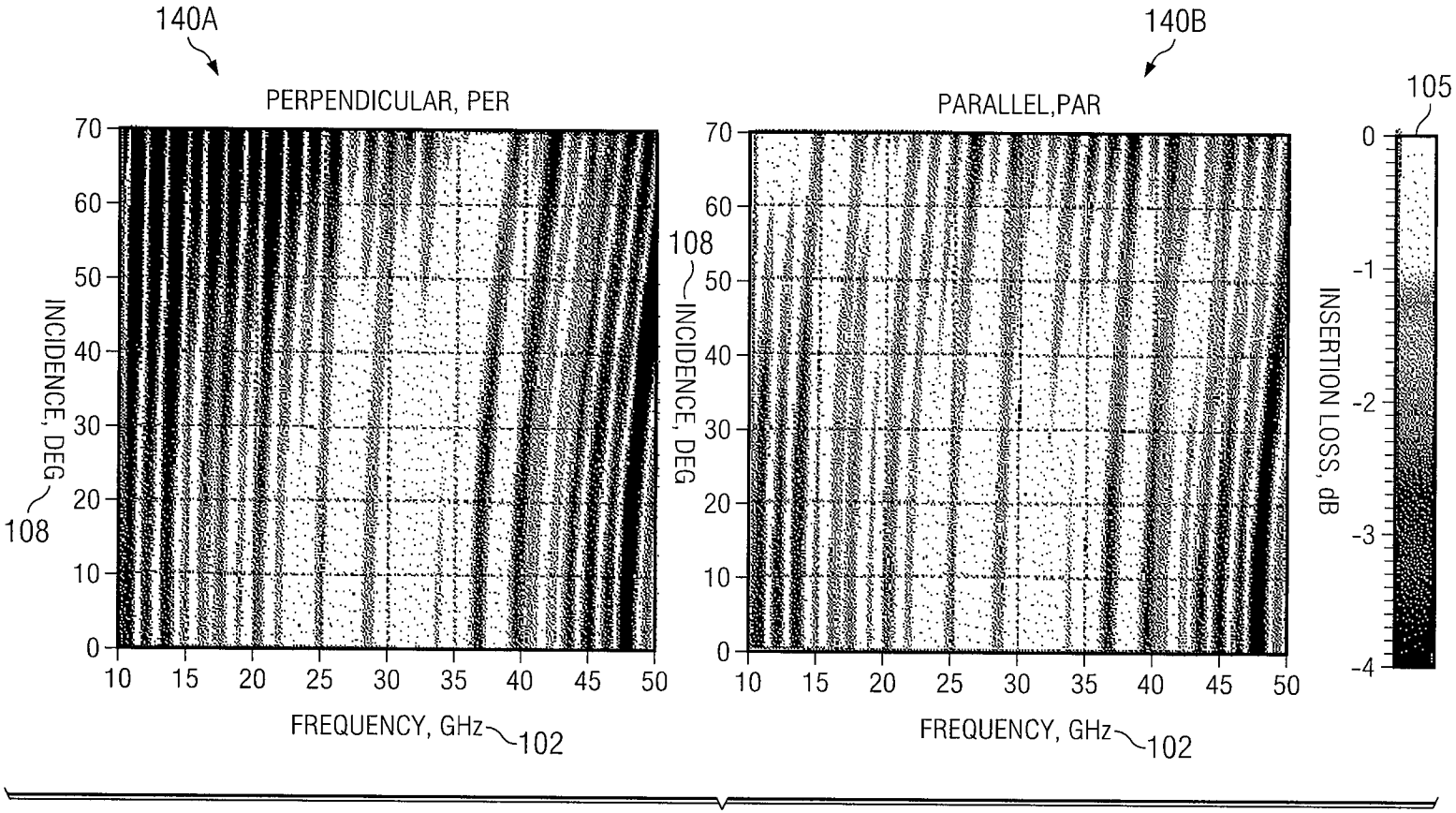
FIG. 10B shows graphs of predicted radome insertion loss corresponding to the radome cover of FIG. 10A.

The graphs 140A, 140B of FIG. 10B are RF transmission loss performance corresponding to the following thicknesses for the radome cover 40E:

| Layer | Thickness (mils) |
|---|---|
| RF Matching Sheet (e.g., SPECTRA ®) | 62.5 |
| Adhesive | 5 |
| Ceramic (e.g., Alumina) | 500 |
| Adhesive | 5 |
| Backing Plate (e.g., NEXTEL ™) | 200 |
| Adhesive | 5 |
| Ceramic (e.g., Alumina) | 500 |
| Adhesive | 5 |
| Backing Plate (e.g., NEXTEL ™) | 200 |
| Adhesive | 5 |
| RF Matching Sheet (e.g., SPECTRA ®) | 62.5 |

FIG. 10B corresponds to a radome with two ballistic layers similar to radome cover 40E of FIG. 10A which is optimized at 31 GHz up to 55 degrees scan for 1 decibel RF loss.

Figure 11B:
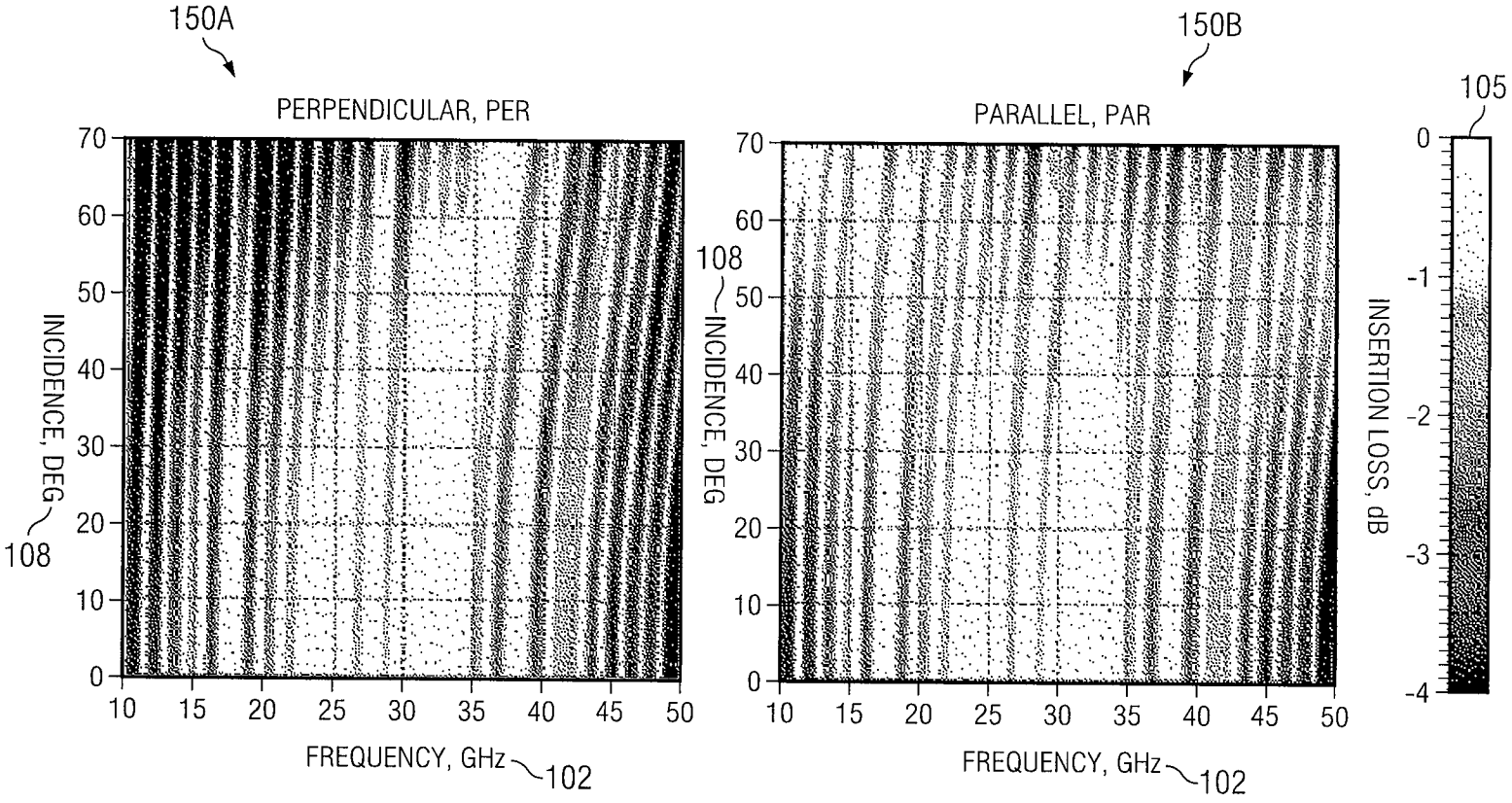
FIG. 11B shows graphs of predicted radome insertion loss corresponding to the radome cover of FIG. 11A.

Radome design for desired frequency bands may be achieved by adjusting the materials and thickness of the ballistic layers and matching layers. It may be desirable to maintain a small loss tangent for the overall radome cover. More layers may result in more loss. However, more loss may be acceptable if the radome cover is designed to function with higher loss levels. The addition of a reinforcement layer (shown in FIG. 7A) may also increase the loss of the radome cover. The loss tangent for each layer of the radome cover may be small for a thick layer but may be higher for layers with less thickness. The graphs 150A, 150B of FIG. 11B are RF transmission loss performance corresponding to the following thicknesses for the radome cover 40F:

| Layer | Thickness (mils) |
|---|---|
| RF Matching Sheet (e.g., SPECTRA ®) | 62.5 |
| Adhesive | 5 |
| Ceramic Core (e.g., Alumina) | 750 |
| Adhesive | 5 |
| Backing Plate (e.g., NEXTEL ™) | 200 |
| Adhesive | 5 |
| Ceramic Core (e.g., Alumina) | 250 |
| Adhesive | 5 |
| Backing Plate (e.g., NEXTEL ™) | 200 |
| Adhesive | 5 |
| RF Matching Sheet (e.g., SPECTRA ®) | 62.5 |

Each of the graphs 110A, 110B, 120A, 120B, 130A, 130B, 140A, 140B, 150A, and 150B show by shading a RF transmission loss in decibels (dB) of transmitted energy through the radome covers 40A, 40B, 40C, 40E, and 40F over various frequencies 102 and incidence angles 108. The scale 105 indicates that a lighter color in the graphs 110A, 110B, 120A, 120B, 130A, 130B, 140A, 140B, 150A, and 150B represent a lower transmission loss. The incidence angles 108 are measured from boresight. Graphs 110A, 120A, 130A, 140A, and 150A, are loss of the electric field perpendicular to the plane of incidence at incidence angles 108 from boresight while graphs 110B, 120B, 130B, 140B, and 150B are RF transmission loss of the electric field parallel or in the plane of incidence at incidence angles 108 from boresight. Using graphs 110A, 110B, 120A, 120B, 130A, 130B, 140A, 140B, 150A, and 150B optimization can occur by selecting a particular band of frequency 102 for a particular range of desired incidence angles 108.

Figure 8:
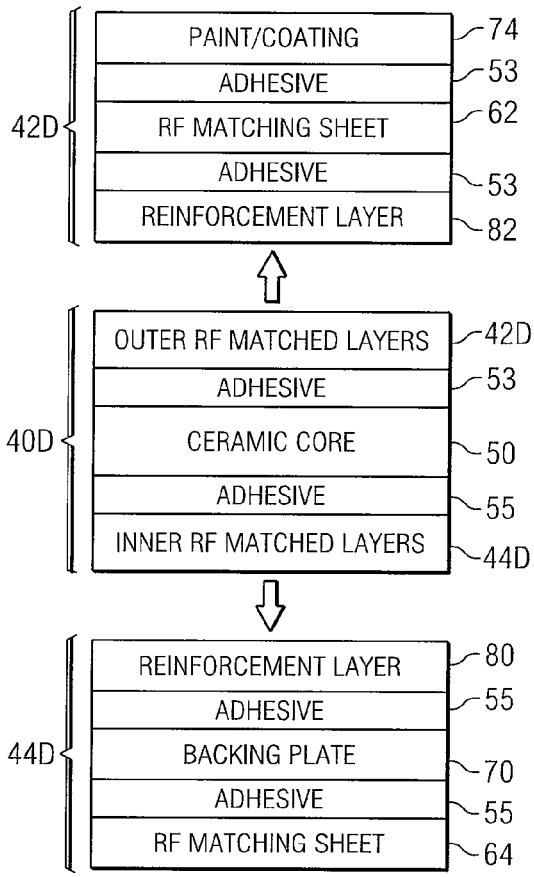
FIG. 8 is an illustration of variations of a radome cover, according to an embodiment of the invention.

FIG. 8 is an illustration of variations of a radome cover 40D according to an embodiment of the invention. The radome cover 40D of FIG. 8 may be similar to the radome cover 40A, 40B, 40C, 40E, and 40F of FIGS. 5A, 6A, 7A, 10A, and 11A including a core 50 (or multiple ballistic layers) sandwiched between matching layers 42D and 44D. Similar to that described with reference to FIG. 5A, the matching layers 42B, 44B are utilized to impedance match the radome cover 40A for optimum radio frequency (RF) propagation through the radome cover 40A. Accordingly, the selection of the type of and thickness of the matching layers 42D, 44D in particular embodiments may vary according to the properties of the core 50 (or multiple ballistic layers) and operating frequencies of the electronics.

The radome cover 40D of FIG. 8 illustrates that the matching layers 42D, 44D may be made of any of a variety of materials. An example given in FIG. 8 is that matching layer 42D may be made of a paint/coating layer 74, a RF matching sheet 62, and a reinforcement layer 82 and that matching layer 44D may be made of a RF matching sheet 64, a backing plate 70 and a reinforcement layer 80. The RF matching sheets 62 and 64 were described above as were the backing plate 70 and reinforcement layer 80. The reinforcement layer 82 may be similar or different than the reinforcement layer 80. Paint/coating layer 74 may be made of any of variety of materials. Any of a variety of adhesives 53, 55 may additionally be utilized.

Figure 9:
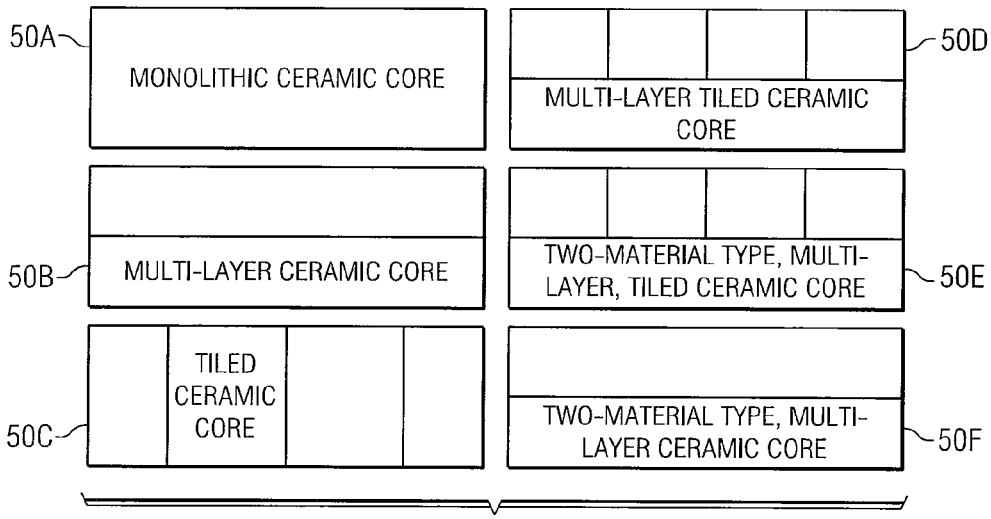
FIG. 9 is an illustration of configurations of a core, according to embodiments of the invention.

FIG. 9 is an illustration of configurations of a core 50 and ceramic layers 52, 54, according to embodiments of the invention. As described with reference to FIG. 5A, the core 50 ceramic layers 52, 54, may be made of one or more than one type of material and the core 50 ceramic layers 52, 54, may be monolithic or tiled in construction. In the case of tiles, hexagonal tiles, for example, can be bonded in place to form a layer which better addresses multi-hit capability.

Core 50A shows a monolithic configuration. Core 50B shows a multi-layer, same material configuration. Core 50C shows a tiled, same material configuration. Core 50D shows a partially tiled, multi-layer, same material configuration. Core 50E shows a partially tiled, multi-layer, multi-material configuration. Core 50F shows a multi-layer, multi-material configuration. Other configuration will become apparent to one or ordinary skill in the art.

Although the present invention has been described with several embodiments, a myriad of changes, variations, alterations, transformations, and modifications may be suggested to one skilled in the art, and it is intended that the present invention encompass such changes, variations, alterations, transformation, and modifications as they fall within the scope of the appended claims.

What is claimed is:

1. A radio frequency assembly comprising:

a radome cover, comprising:

a first and second ballistic layer, the first ballistic layer comprising a first ceramic layer, the second ballistic layer comprising a second ceramic layer, each ceramic layer having a dielectric constant greater than six, and at least two matching layers, the first and the second ballistic layers being sandwiched between the at least two matching layers, the at least two matching layers impedance matched to the first and the second ballistic layers for a frequency band;

backing plates disposed between the first and second ceramic layers and between one of the first and second ceramic layers and a proximal one of the at least two matching layers; and at least one radio frequency component disposed beneath the radome cover, wherein the first and second ceramic layers have a dielectric constant greater than 6, the at least two matching layers have a dielectric constant of less than 3.5 and the backing plates have a dielectric constant between 3 and 7.

2. The radio frequency assembly of claim 1, wherein each of the at least two matching layers has an average dielectric constant less than 3.5.

3. The radio frequency assembly of claim 1, wherein each ceramic layer has a dielectric constant greater than or equal to nine.

4. The radio frequency assembly of claim 1, wherein the first ceramic layer comprises alumina.

5. The radio frequency assembly of claim 4, wherein the second ceramic layer comprises silicon nitride.

6. The radio frequency assembly of claim 1, wherein the at least two matching layers comprise polyethylene.

7. The radio frequency assembly of claim 1, wherein the radome cover further comprises:

a reinforcement layer operable to dissipate kinetic energy.

8. The radio frequency assembly of claim 1, wherein the first ceramic layer and the second ceramic layer are approximately equal in thickness.

9. The radio frequency assembly of claim 1, wherein the first ceramic layer is approximately three times the thickness of the second ceramic layer.

10. The radio frequency assembly of claim 1, wherein at least one of the first and second ceramic layers is up to about 12 times thicker than each of the at least two matching layers and up to about 3.75 times thicker than each of the backing plates.

11. The radio frequency assembly of claim 1, further comprising adhesive disposed between adjacent layers and between layers adjacent to backing plates, wherein at least one of the first and second ceramic layers is up to about 150 times thicker than the adhesive.

12. A radome cover comprising:

a first and a second ceramic layer;

at least two matching layers, the first and second ceramic layers sandwiched between the at least two matching layers, the at least two matching layers impedance matched to the first and second ceramic layers over a frequency band; and backing plates disposed between the first and second ceramic layers and between one of the first and second ceramic layers and a proximal one of the at least two matching layers, wherein the first and second ceramic layers have a dielectric constant greater than 6, the at least two matching layers have a dielectric constant of less than 3.5 and the backing plates have a dielectric constant between 3 and 7.

13. The radome cover of claim 12, wherein at least one of the ceramic layers comprises alumina;

the first and second ceramic layers each have a dielectric constant greater than six;

the at least two matching layers has an average dielectric constant less than 3.5.

14. The radome cover of claim 12, wherein at least one of the ceramic layers comprises alumina.

15. The radome cover of claim 12, wherein at least one of the ceramic layers comprises silicon nitride.

16. The radome cover of claim 12, wherein the at least two matching layers comprise polyethylene.

17. The radome cover of claim 12, further comprising:

a reinforcement layer operable to dissipate kinetic energy.

18. The radome cover of claim 12, wherein at least one of the ceramic layers has a dielectric constant greater than six.

19. The radome cover of claim 18, wherein each of the at least two matching layers has an average dielectric constant less than or equal to 3.5.

20. The radome cover of claim 18, wherein at least one of the ceramic layers has a dielectric constant greater than or equal to 9.8.

21. The radome cover of claim 12, wherein the first ceramic layer is approximately the same thickness as the second ceramic layer.

22. The radome cover of claim 12, wherein the first ceramic layer is approximately three time the thickness of the second ceramic layer.

23. A method of creating radome cover, the method comprising:

selecting a first and a second ceramic layer;

selecting at least two matching layers that are impedance matched to the first and second ceramic layers;

coupling the first and the second ceramic layers between the at least two matching layers; and disposing backing plates between the first and second ceramic layers and between one of the first and second ceramic layers and a proximal one of the at least two matching layers, wherein the first and second ceramic layers have a dielectric constant greater than 6, the at least two matching layers have a dielectric constant of less than 3.5 and the backing plates have a dielectric constant between 3 and 7.

24. The method of claim 23, wherein at least one of the ceramic layers comprises alumina, selecting a first and a second ceramic layer comprises selecting a first ceramic layer thickness and a second ceramic layer thickness, the at least two matching layers comprise polyethylene; and selecting the at least two matching layers comprises selecting a thickness of each of the at least two matching layers.

* * * * *